US012209421B2

(12) United States Patent
Fritzøe et al.

(10) Patent No.: US 12,209,421 B2
(45) Date of Patent: Jan. 28, 2025

(54) HEAVY DUTY TRANSOM FOR STRUCTURAL SUPPORT SYSTEMS

(71) Applicant: Frico AS, Undrumsdal (NO)

(72) Inventors: Steven Fritzøe, Tønsberg (NO); Danny Zarb, Belmont (AU)

(73) Assignee: Frico AS, Undrumsdal (NO)

( * ) Notice: Subject to any disclaimer, the term of this patent is extended or adjusted under 35 U.S.C. 154(b) by 315 days.

(21) Appl. No.: 17/626,231

(22) PCT Filed: Jul. 3, 2020

(86) PCT No.: PCT/NO2020/050188

§ 371 (c)(1),
(2) Date: Jan. 11, 2022

(87) PCT Pub. No.: WO2021/010838

PCT Pub. Date: Jan. 21, 2021

(65) Prior Publication Data

US 2022/0268037 A1 Aug. 25, 2022

(30) Foreign Application Priority Data

Jul. 12, 2019 (NO) ..... 2019 0881

(51) Int. Cl.
*E04C 3/04* (2006.01)
*E04G 1/04* (2006.01)
(Continued)

(52) U.S. Cl.
CPC ..... *E04G 1/04* (2013.01); *E04C 3/04* (2013.01); *E04G 7/26* (2013.01); *E04G 7/303* (2013.01);
(Continued)

(58) Field of Classification Search
CPC ..... E04C 3/04; E04C 2003/0456; E04G 7/26; E04G 7/303; E04G 7/308
See application file for complete search history.

(56) References Cited

U.S. PATENT DOCUMENTS 3,992,118 A * 11/1976 Siegers ..... E04G 7/308 182/186.7
4,323,319 A 4/1982 Adams
(Continued)

FOREIGN PATENT DOCUMENTS

CA 2743832 C 5/2018
DE 2422738 A1 * 11/1975
(Continued)

OTHER PUBLICATIONS

International Search Report Patent Cooperation Treaty PCT, International application No. PCT/NO2020/050188, International filing date Jul. 3, 2020, dated Sep. 16, 2020.
(Continued)

*Primary Examiner* — Christine T Cajilig
(74) *Attorney, Agent, or Firm* — Flener IP & Business Law; Zareefa B. Flener

(57) ABSTRACT

This publication relates to a tubular transom in particular for temporary structures, such as scaffolding or false work and similar structure, having ends configured to be connected to verticals at node sections arranged at intervals on the verticals. Each end of the transom comprises a fastening device with an integrated profile part, releasably attached to the tubular transom in an opening at the ends of the tubular transom. The transom comprises a first and at least second elongate, parallel and hollow tube elements, interconnected at least at each end by intermediate integrated web plates, rigidly fixed to said at least two tube elements. A contact surface of the opening in the first tube, is transversally arranged relative to one or more web plates. A contact
(Continued)

surface of the opening in the second tube is transversally arranged relative to one or more web plates. The opening at the ends of the transom having at least partly a complimentary shape.

7 Claims, 5 Drawing Sheets

(51) Int. Cl.
*E04G 7/26* (2006.01)
*E04G 7/30* (2006.01)
*E04G 7/34* (2006.01)

(52) U.S. Cl.
CPC ..... *E04G 7/34* (2013.01); *E04C 2003/0456* (2013.01)

(56) References Cited

U.S. PATENT DOCUMENTS

| | | | | |
|---|---|---|---|---|
| 4,398,841 | A * | 8/1983 | Kojima | F16B 7/22 52/645 |
| 4,960,343 | A | 10/1990 | Reilly | |
| 2003/0177735 | A1 | 9/2003 | Seeba et al. | |

FOREIGN PATENT DOCUMENTS

| | | | | |
|---|---|---|---|---|
| DE | 10114679 | A1 | 9/2002 | |
| EP | 1650376 | A2 * | 4/2006 | E04B 7/022 |
| EP | 3228768 | A1 | 10/2017 | |
| EP | 3298208 | A1 | 3/2018 | |
| FR | 1261335 | A * | 5/1961 | |

OTHER PUBLICATIONS

Norwegian Search Report, Patent Application No. 20190881, Date of report Feb. 10, 2020.

Patent Cooperation Treaty PCT Written Opinion of the International Searching Authority, International application No. PCT/NO2020/050188, International Filing date Jul. 3, 2020, published Jan. 21, 2021 (date found on Patentscope).

Patent Cooperation Treaty PCT Notification of Transmittal of the International Preliminary Report on Patentability, International application No. PCT/NO2020050188, dated Oct. 12, 2021.

* cited by examiner

HEAVY DUTY TRANSOM FOR STRUCTURAL SUPPORT SYSTEMS

FIELD OF THE INVENTION

The present invention relates to structural systems such as used for temporarily and/or permanent assembled structures such as scaffolding, falsework, beams, bridges, staging, ski jumps and slopes and similar. In particular, the invention relates to a tubular transom for scaffolding or falsework, as well as the aforementioned structures, having ends configured to be connected to verticals at node sections arranged at intervals on the verticals, where end of the transom comprises a fastening device with an integrated profile part, releasably attached to the tubular transom in an opening at the ends of the tubular transom.

BACKGROUND OF THE INVENTION

State of the art is reflected in traditional temporarily assembled structural support systems, such as scaffolding and falsework. Structural support systems are used in several applications, to support and provide safe access related to construction and maintenance of buildings, constructions or the like and to temporarily carrying formwork and building structures until self-supported.

Scaffolding and falsework are typically temporary structures, which are assembled at construction site and disassembled upon completion of construction works. It is a modular system of metal components where the components are reusable—assembled and dismounted from site to site.

In conventional scaffolding or falsework, the components within the structural system usually comprise verticals or upright members, horizontal members, cylindrical transoms for vertical and horizontal purposes and various types of coupling elements or connectors. The verticals and horizontals transoms are connected together in nodes by means of coupling elements that are usually fixed at intervals on the vertical transoms and where the components are of metal, usually steel.

Typically, the transoms and coupling elements are joined together with the transom engaging with associated arms or profiles of the coupling elements. The transom and coupling elements are interlocked together by a so-called locking device. Ringlock™, Allround™, Kwikstage™ and Cuplock™ are well known scaffolding systems.

The Cuplock™ system is described in GB 1 463 867 and consists of a bottom cup permanently and rigidly fixed by welding to a vertical pole at given intervals along the pole, with a loose and movable top cup above each bottom cup to engage a horizontal transom's end configuration for connecting the horizontal transom to the vertical pole by means of the bottom and top cups. Welding is used to permanently and rigidly fix components such as bottom cup, wedges and mechanical stoppers of the system to the vertical pole and also to establish a permanent connection between the horizontal transom and the blade end configuration of the horizontal pole. The node configuration on the transom is in the form of oppositely directed tongues projecting laterally out from the horizontals, and upright member having opposed retaining cup shaped elements on the pole, adapted to receive said tongue, one retaining element being fixed to the upright and the other retaining element being moveable along the upright member with respect to said fixed element.

US 2014/0086669 discloses a modular scaffold component of different material components that advantageously used the durability and reliability of conventional type steel ledger heads adhesively secured to by an aluminium or aluminium alloy structural member. The structural member is an extruded elongate tube and may have a non-circular cross section having thickened top and bottom portions interior to a circular outer surface. The steel type ledger head may be removably and exchangably fixed to the tube by means of a pin/hole solution.

WO 93/01380 relates to a scaffold, comprising uprights and transverse tubular braces formed of aluminium. Each upright includes a tubular post extruded with external grooves and a number of flange assemblies for secure attachment of the transverse tubular braces by means of a wedge formed locking device. Both the flanges and the wedge formed locking device are also made of aluminium, the joint fixed to the ends of the braces being forged aluminium. The wedge formed locking device is permanently fixed to the bracings by welding of the two parts together.

DE 10114679 A1 relates to a component system for podia/stages, stands, platforms, stairs, etc. comprising a sub-construction with vertical posts having one or more post connecting units arranged in a specified pattern in the longitudinal direction of the posts, longitudinal bars, transverse bars, diagonals, and covering devices with covering plates. The covering devices are joined to side wall supports having at each end region a side wall support connecting unit for removably connecting to a corresponding post connecting unit of a vertical post. The side wall supports are extruded profiles which can be cut into any lengths.

When sturdy structural system for heavy duties having inherent, increased load bearing capacity and minimized weight are required, traditional structural system assemblage becomes complicated and often require additional internally placed supporting components to reinforce the structural system so that it can tolerate higher loads than single cylindrical transom conventionally used.

There is therefore a need for an enhanced scaffold or falsework systems able to carry increased weight and carry increased loads without having to increase the complexity, weight and number of elements in the system scaffold or falsework system accordingly. Moreover, there is a need for an improved joint or node system for fixing the bracings or transoms to the vertical without having to complicate the joints or nodes correspondingly, while at the same time maximizing strength-to-weight ratio of the structural system.

SUMMARY OF THE INVENTION

The main object of the invention is to provide a transom with an increased load capacity compared to conventionally prior art transoms or bracings in use in prior art structural systems of scaffolding or falsework, thereby contributing to a stronger and more rigid scaffold or falsework, able to take larger loads without to any substantial degree having to increase the number of verticals or bracings, or the dimensions or material thickness.

Another object of the invention is to provide a transom solution made of a material where most of the elements of the transom system may be extruded.

Another object of the invention is to provide a more rigid and load carrying joint or node arrangement with an enhanced strength-to-weight ratio.

Another object of the invention is to provide a transom with an end cross section profile allowing fitting with currently existing decking units, fastening point and/or locking devices.

A further object is to provide a more reliable joint or node between a bracing or transom and a vertical, providing a more robust joint or node, allowing for support of increased loads or forces.

Another object of the invention is to provide a transom design profile that can be adapted to many structural systems by simply substituting the locking system fittings or profile.

Yet another object of the invention is to provide a system where all elements may be made of a light material suitable for extruding, such as aluminium.

Another object of the present invention is to provide a system where the ends of the transom are interchangeable and/or replaceable.

The objective is achieved according to the invention by a tubular transom as defined in the preamble of the independent claim, having the features of the characterising portion of the independent claim.

A number of non-exhaustive embodiments, variants or alternatives of the invention is defined by the dependent claims.

The present invention attains the above described objectives by providing an attachment means for a transom, the attachment means having a first contact surface and a second opposite facing contact surface for engaging inward faces of a I-beam profile of a end connector.

The present invention attains the above described objectives by providing a tubular transom, in particular for temporary structures such as scaffolding or falsework, having ends configured to be connected to verticals at node sections arranged at intervals on the verticals, where each end of the transom comprises a fastening device with an integrated profile part, releasably attached to the tubular transom through an opening at the ends of the tubular transom.

The tubular transom comprises a first and at least second elongate, parallel and hollow tube elements, interconnected at each end; a contact surface of the opening in the first tube, is transversally arranged relative to one or more web plates; a contact surface of the opening in the second tube is transversally arranged relative to one or more web plates; and the opening at the ends of the transom having at least partly a shape complimentary to the shape of the profile part for receiving an end of the profile part into an interior end part of the first and/or second tube.

In an embodiment, the first and the at least second elongate, parallel and hollow tube elements are interconnected by means of intermediate integrated web plates, rigidly fixed to said at least two tube elements.

In an embodiment, the contact surface in the first tube is oppositely facing the contact surface in the second tube and both contact surfaces are arranged for at least partially engaging respectively with first faces and second faces of the profile part.

In another embodiment, the contact surfaces have a shape chosen from a group comprising flat and curved shapes.

In another embodiment, the integrated profile part of the fastening device having an I- or H- or a multiple I- or H beam cross sectional shape.

In another embodiment, an opening extends through the intermediate integrated web plates and is ended at one end in first tube and an opposite end is ended in the second elongate, parallel hollow tube.

In another embodiment, the tubular transom further comprises attachment means for temporally and rigidly attaching the end connector to the transom.

In another embodiment, the transom has at least one recess part arranged at one end of the transom for receiving a locking device.

In another embodiment, the transom is made of a lightweight material, such as aluminium.

In another embodiment, the transom is made of extruded aluminium and the opening between the two intermediate web plates extends along the entire length of the transom.

The first tube and/or the second tube of the tubular transom may comprise a circular or semi-circular outer shape.

The present invention comprises a technological advantage over known apparatus and system in that the transom of the invention has both a cross section configuration and an end configuration that contribute to increased stiffness, larger load carrying capacities and a more rigid, interchangeable end connection, providing adaptability to different node or joint systems for in scaffolding or falsework systems, including interchangeability.

The transom and the attachment means according to the present invention provides several further advantageous effect:

It makes it possible to build structural system of greater strength using conventional coupling elements.

It makes it possible to build structural system of greater length that are resistant to deflection.

It makes it possible to mix and match single and double tubular transom according to special needs.

It makes it possible to build a lightweight structural systems for example by using aluminium as a building material for the transom.

It makes it possible to maintain and restrict the ability of decking units to dislodge due to, for example, excessive wind load and accidental dislodgement, from the located position.

It allows for the connections of standard scaffolding system accessories, thereby increasing versatility.

It allows for the use of any type of decking, for example timber, steel, hook-type or composite material, thereby increasing versatility.

It allows for the use of currently existing decking units or locking systems to maintain proper functionality.

BRIEF DESCRIPTION OF THE DRAWINGS

The above and further features of the invention are set forth with particularity in the appended claims and together with advantages thereof will become clearer from consideration of the following detailed description of an [exemplary] embodiment of the invention given with reference to the accompanying drawings.

The invention will be further described below in connection with exemplary embodiments, which are schematically shown in the drawings, wherein:

FIG. 2A shows schematically in perspective a view of the end connector 400; FIG. 2B shows an end view of the end connector 400, seen from the end intended to be inserted into an opening 100, 100A in the transom 300, 300A; FIG. 2C shows schematically end views of different cross sectional shapes of the end of the profile part 200 of an end connector 400, requiring corresponding or complimentary shape of the openings 100, 100A at the end of the transom 300, 300A; and FIG. 2D shows schematically and in perspective a view of a end connector 400 and an end of the transom 300 in exploded view;

DETAILED DESCRIPTION OF THE SHOWN EMBODIMENTS

Figure 1:
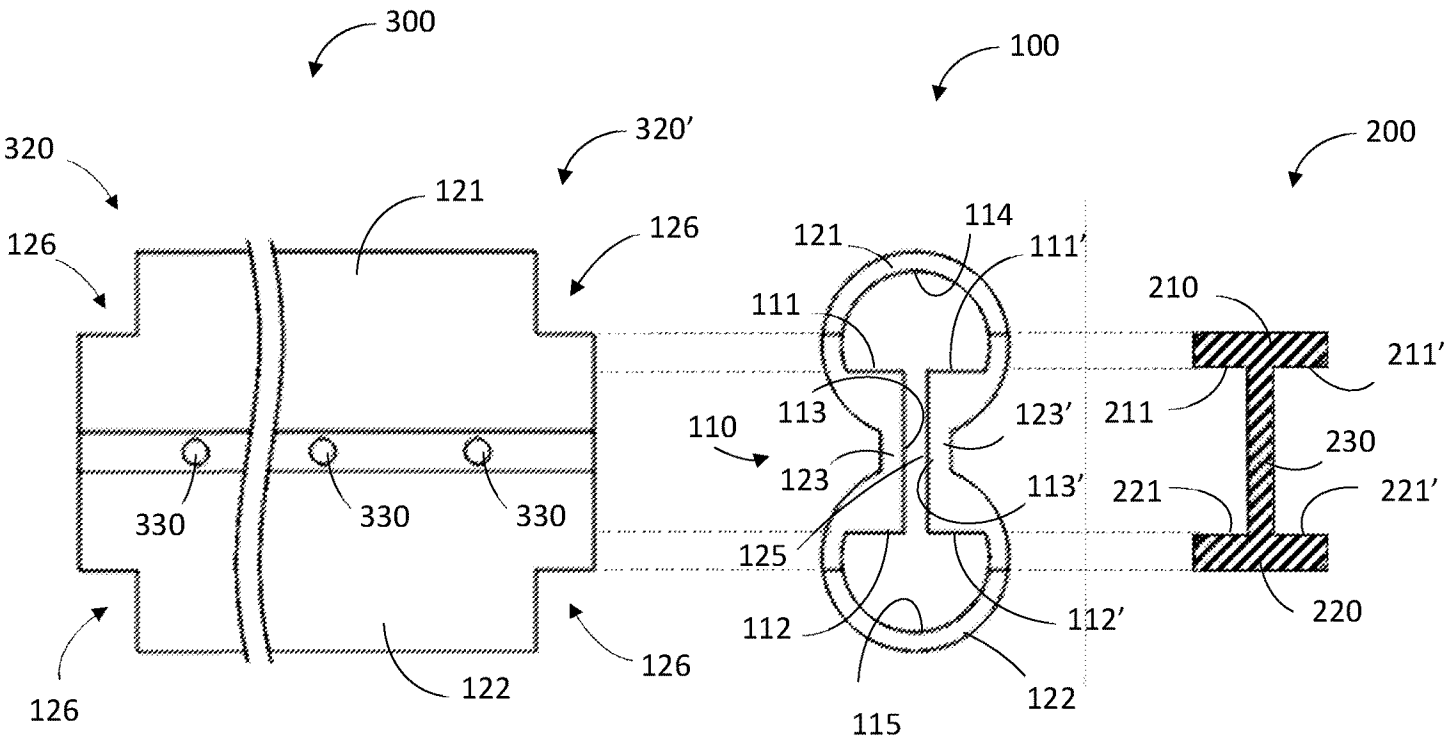
FIG. 1 shows schematically a side view of an embodiment of a tubular transom 300, a cross section of the tubular transom end/opening 100 and a front view of an embodiment of a complementary profile part 200 to be attached to the end of the transom 300.

Various aspects of the disclosure are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the disclosure disclosed herein, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. It should be understood that any aspect of the disclosure disclosed herein may be embodied by one or more elements of a claim.

It should be noted that although a double tubular transom configuration is shown, the transom may comprise several parallel tubes interconnected by intermediate web(s) or web plate(s) or by a grid shaped intermediate web or web plate system. As will be described in further detail below, the web or web plate may be provided with a planar opening in open communication with the hollow tubular ends of the transom tube elements, so as to be complementary with the more or less correspondingly complementary shaped end of the end connector.

The invention will be further described in connection with exemplary embodiments, which are schematically shown in the drawings.

Figure 1A:
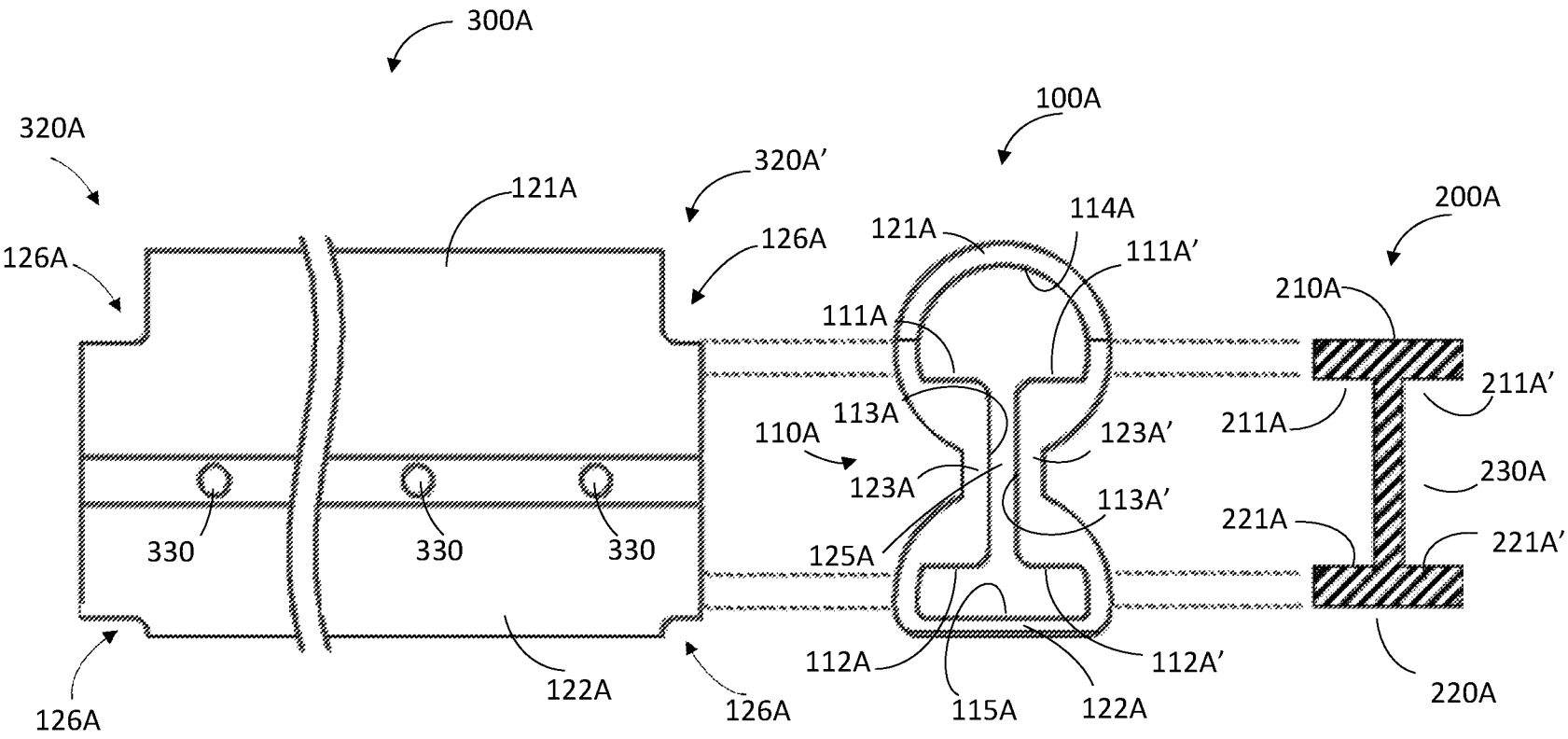
FIG. 1A shows schematically a side view of an alternative embodiment of a tubular transom 300A, a cross section of the tubular transom end/opening 100A and a front view of an embodiment of a complementary profile part 200 to be attached to the end of the transom 300A. The embodiment in FIG. 1A has the same technical properties as the embodiment in FIG. 1, including all specified parts, the difference being the alteration to bottom tubular transom creating a more flat bottom surface.
Figure 2A:
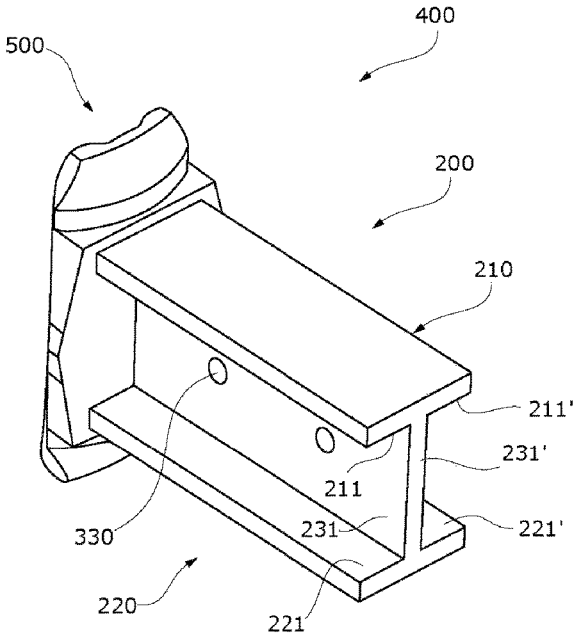
FIGS. 2A-D shows schematically multiple views of an end connector 400 with a fastening device 500 and the profile part 200, where
Figure 2B:
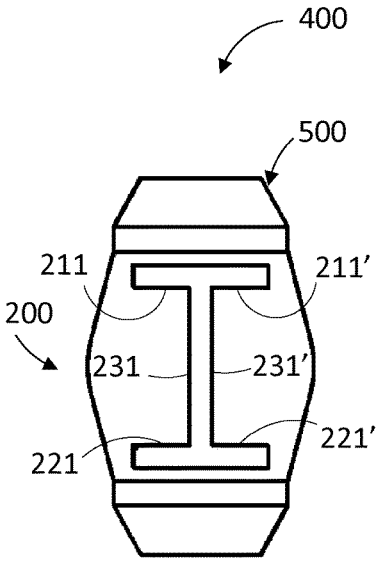
Figure 2C:
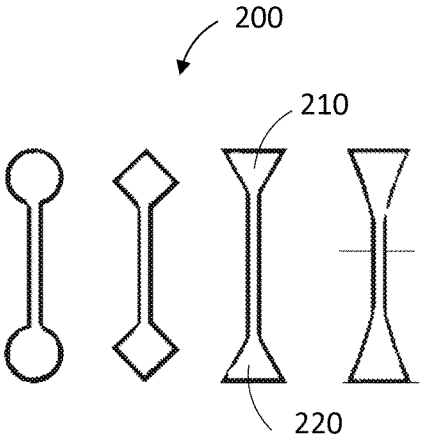
Figure 2D:
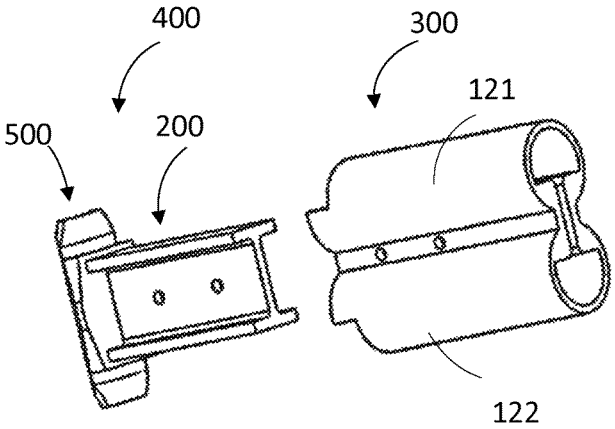
Figure 3:
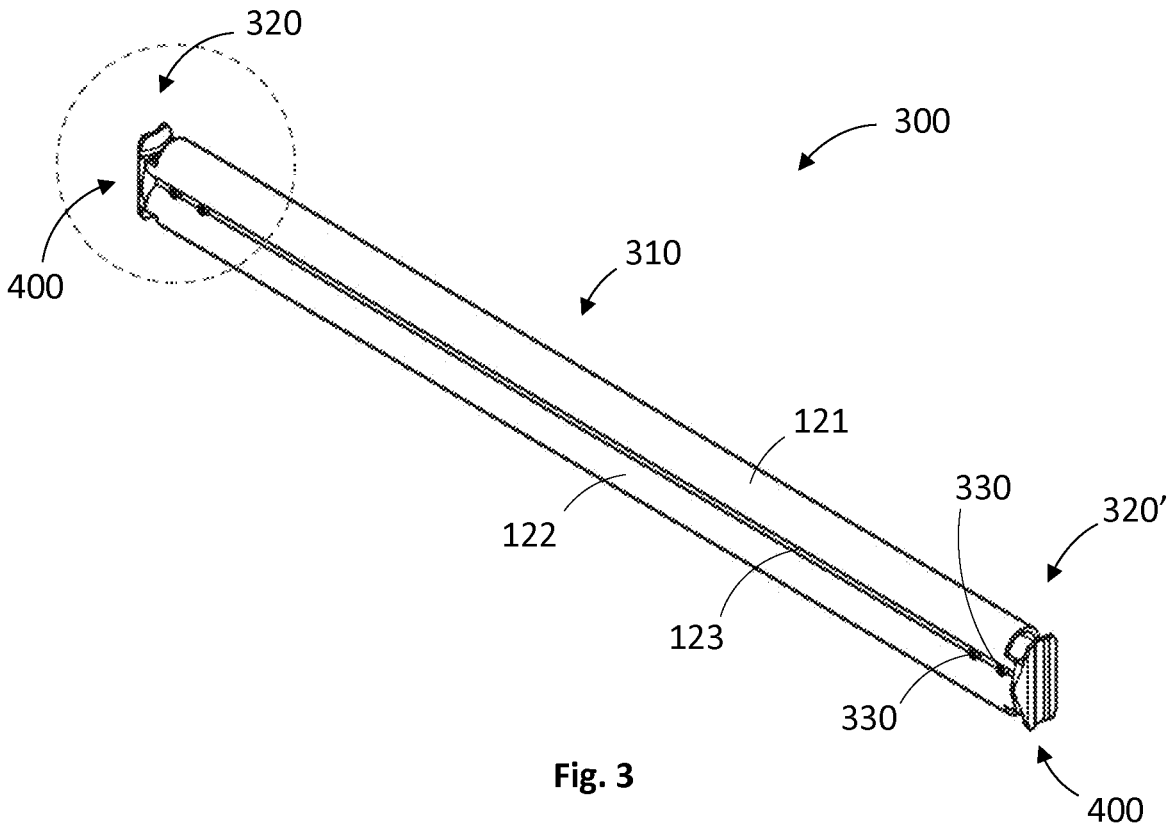
FIG. 3 shows schematically and in perspective a view of an embodiment a tubular transom 300 with an end connector 400 attached to the tubular transom 300.
Figure 5:
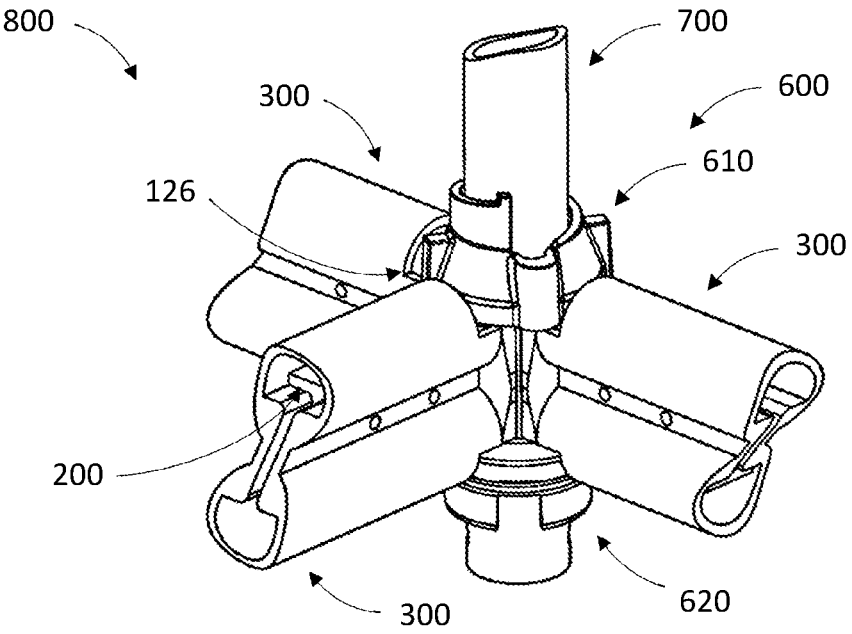
FIG. 5 shows schematically a node section 800 with multiple shown embodiments of tubular transoms 300 according to the present invention, attached to end connectors 400 and locked with locking devices 600 on a vertical pole 700 of a scaffolding.
Figure 6:
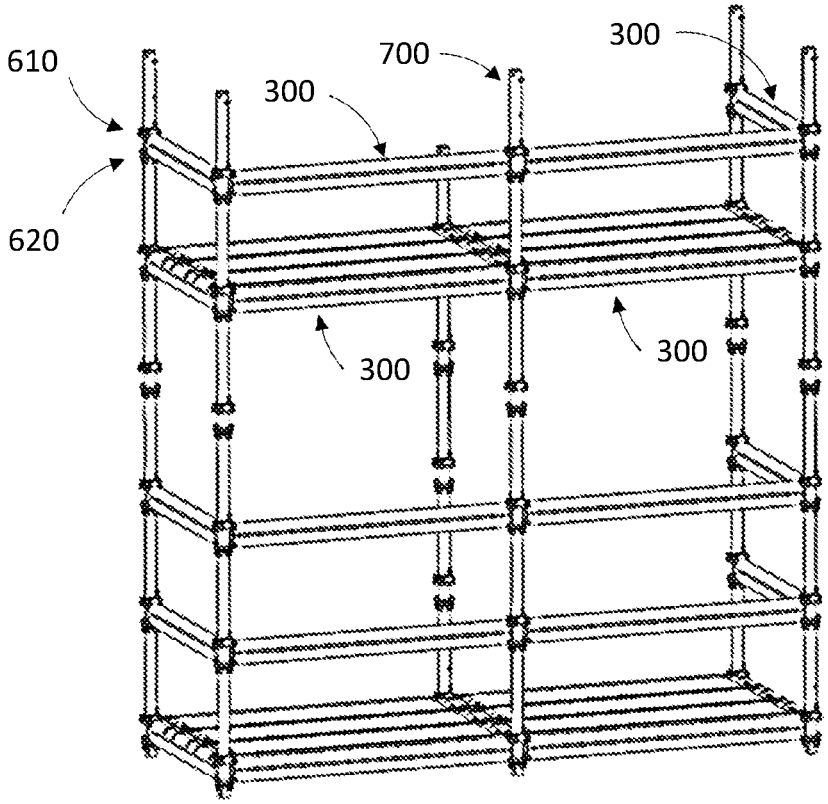
FIG. 6 shows schematically view of a structural system assembly with multiple transoms 300, 300A, end connectors/couplings 400 and locking devices 600.

As shown on FIG. 1, 1A, 2A and FIG. 2D, the embodiment shown relates to a tubular transom 300, 300A having two tubes 121, 121A and 122, 122A, and a scaffolding or falsework connector 400 comprising a fastening device 500 and a profile part 200, 200A. As can be seen in particular from FIG. 1A, the word "tube" in this specification, does not refer only to tubes having a circular profile, but is intended also to include tubes with different cross sections, such as the near half-circle shape of the tube 122A of FIG. 1A. The profile part 200, 200A is arranged for engaging with the transom 300, 300A as illustrated in FIG. 2D and FIG. 3. When the transom 300, 300A and the end connector 400 are engaged, and removably attached to each other, they can be used in scaffolding or falsework node connections as shown in FIG. 5 and FIG. 6. It should also be noted that the transom system disclosed may be used in falsework assemblies and other similar structure.

FIG. 1 shows schematically a side view of an embodiment of a tubular transom 300; a cross section of the shown embodiment of the tubular transom end/opening 100; and a front view of an embodiment of a complementary profile part 200 to be attached to the end of the transom 300.

FIG. 1A shows schematically a side view of an alternative embodiment of a tubular transom 300A; a cross section of the alternative embodiment of the tubular transom end/opening 100A; and a front view of an embodiment of a complementary profile part 200A to be attached to the end of the transom. The profile part 200A may be identical to the profile part 200 of FIG. 1, suitable to fit the opening 100 of transom 300, or the opening 100A of transom 300A.

The double tubular cross section of the transom 300, 300A shown has an advantage in that it has a greater strength-to-weight ratio than compared to singular tubular transom conventionally used in the scaffolding and falsework technical field. Another advantage is that the profile end part 200, 200A makes the connection between the verticals and the horizontal transoms more robust. Further, the profiled part 200, 200A when inserted in the transom 300, 300A efficiently limits movements of the transom 300, 300A relative to the corresponding locking device on the vertical, leading to a more stable scaffolding or falsework structure.

In the following sections, the elements of the transom and end connector will be described in more details.

On the left side of FIG. 1 and FIG. 1A, the transom 300, 300A is shown with two ends 320, 320', 320A, 320A'. In the embodiment of FIGS. 1 and 1A, both ends 320, 320', 320A, 320A' comprise a profiled opening or hole 100, 100A, i.e. an open end section of the hollow tube element 121, 122, 121A, 122A exposing at least a part of the interior of the hollow tube and which may be used to attach an end connector 400. The opening 100 cross-section is shown from a front view in the middle of FIG. 1. The opening 100A cross-section is shown from a front view in the middle of FIG. 1A. In the embodiment of FIG. 1 and FIG. 1A, the opening 100, 100A cross-section is the same as the cross section of, and along, the whole transom 300, 300A, as also shown in FIG. 2.

On right side of FIG. 1 and FIG. 1A, the profiled part 200, 200A is shown. The I- or H-shape beam profile is arranged for engaging with the more or less correspondingly shaped opening 100, 100A at each end of the transom 300, 300A. The I- or H-beam profile can be rigidly and removably attached inside the opening 100, 100A, and thereby rigidly and removably attached inside of the transom 300, 300A.

According to the embodiment shown in FIG. 1 and FIG. 1A, the profile part 200, 200A is provided with a first flange 210, 210A and a second flange 220, 220A and an intermediate web 230, 230A, rigidly connecting the flanges 210, 220, 210A, 220A to an integrated, rigid body and solid body.

According to the embodiment shown in FIG. 1 and FIG. 1A, the transom 300, 300A comprises a transom member 310 (as shown in FIG. 3) with two hollow tubes 121, 122, 121A, 122A connected by a web plate or portion 123, 123A, provided with a slot extending along the entire length of the transom and also extending between the opening in the first and second tubular member 121, 122, 121A, 122A, thus forming an opening suitable for receiving the profiled end 200, 200A of the end connector 400, see also FIGS. 3 and 2D. An advantageous effect of the two tubes 121, 122, 121A, 122A is that it makes the transom 300, 300A more resistant to heavy loads when in use in scaffolding or falsework structures compared to single tube transoms available from prior art and secure an improved and stable fixture for the end connector 400.

It should be noted that the web may either be in the form of a single slotted web, or formed by two parallel web plates 123, 123', 123A, 123A' in spaced relation forming an intermediate slot, rigidly fixed to and extending between the two parallel, hollow tubes 121, 122, 121A, 122A. Moreover, it should be noted that the height of the intermediate web between the two tubes 121, 122, 121A, 122A is governed by the load and/or bending moment to be taken.

The outer surfaces of the two tubes may according to another embodiment coincide in a single adjoining contact point, thus not forming an intermediate web via the web plates 123, 123', 123A, 123A', provided a vertical slot through the adjoining section and in open communication with the two holes through the transom 300, 300A, extending through the two adjoining parts of the two parallel hollow tubes 121, 122, 121A, 122A.

The opening 100, 100A of the body 110, 110A, is shown in the middle of FIG. 1 and FIG. 1A, this part of FIG. 1 and FIG. 1A showing an end view of the double tubed, elongated transom 300, 300A. The body 110, 110A forming the transom 300, 300A is provided with internal first contact surfaces 111, 111', 111A, 111A' inside the first tube 121, 121A, internal second opposite facing contact surfaces 112, 112', 112A, 112A' inside the second tube 122, 122A, and web contact surfaces 113, 113', 113A, 113A' within the intermediate web or between the web plates 123, 123', 123A, 123A'. The first contact surfaces 111, 111', 111A, 111A' are formed as a flat surface on the inner surface of the first tube 121, 121A, facing the intermediate web or web plates 123, 123', 123A, 123A'. According to the embodiment depicted in FIGS. 1 and 1A, the remaining part of the first tubular connecting inner surface 114, 114A is curved or forming part of a circle, forming a closed loop. Similarly, the second contact surfaces 112, 112', 112A, 112A' and the opening may be configured accordingly. According to the embodiment depicted in FIG. 1A, the transom end/opening 100A comprises a different cross-sectional shape. The upper hollow tube 121A is similar in shape to the upper hollow tube 121 of the embodiment of FIG. 1, while the lower hollow tube 122A of FIG. 1A comprises a flat bottom, resulting in the cross-sectional outer shape of the lower hollow tube 122A comprising a near half-circle shape. The interface for receiving the profile part 200A is unaffected by this difference in tube outer shape. The effect of this shape difference is a reduction in the total height of the transom 300A for example in order to conform to certain regulated height/size restrictions for various parts within temporary structures such as scaffolding or shoring. An effect of the shape difference between 121A and 122A, and 121 and 122 is a different load distribution over the transom cross section, which will have to be considered when assessing the load capacity of the transom. Since the interfacing parts between the profile part 200 and the tubulars 121, 121A and 122, 122A may be equal in the two different embodiments of the transom 300, 300A, the profile part 200A of FIG. 1A may be identical to the profile part 200 of FIG. 1.

In another embodiment, it is the upper hollow tube 121A that comprises the near half-circle shape, while the lower hollow tube 122A comprises a circular shape. In yet another embodiment, both the upper and lower hollow tubes 121, 122, 121A, 122A comprise a near half-circle shape.

It should be noted that as an alternative the opening inside the first and second tube 121, 121A and 122, 122A, together with the opening in the intermediate web may have the same cross section as the profile part 200, 200A, shown to the right in FIGS. 1 and 1A. Alternatively, the top surface of both upper contact surfaces of the flanges of the profile part 200 may have a curved surface corresponding to the shape of the inner surface of the tubular openings through the two interconnected tubes 121, 122, 121A, 122A.

In order to releasably lock or fix the profile part in the opening/hole in the end of the tubular transom, holes 330 may be arranged in the intermediate web or a web plate 123, 123', 123A, 123A', ref, the Figure on the left hand side of FIGS. 1 and 1A, for a bolt to be inserted or screwed into a corresponding threaded, aligned hole (see FIGS. 2A, 2C and 2D) in the web 230, 230A of the profile part 200, 200A of the end connector 400.

The body 110, 110A comprises the first tube 121, 121A, wherein the first tube comprises the first tubular connecting inner surface 114, 114A. The body 110, 110A further comprises the second tube 122, 122A, wherein the second tube comprises the second tubular connecting inner surface 115, 115A. And further, the body also comprises web plates 123, 123', 123A, 123A' wherein the web plates comprise the web contact surface 113, 113', 113A, 113A'. The web plates 123, 123', 123A, 123A' are distantly spaced apart, forming a gap 125, 125A. As shown in FIGS. 1 and 1A, the web plates 123, 123', 123A, 123A' connect the first tube 121, 121A and the second tube 122, 122A. The transom opening 100, 100A as described above is arranged for engaging with the profile part 200, 200A as shown in FIG. 1 and FIG. 1A. The profile part 200, 200A comprises three main parts, a first flange 210, 210A, a second flange 220, 220A, and a web 230, 230A. The first flange 210, 210A comprises first inward faces 211, 211', 211A, 211A'. The second flange 220, 220A comprises second inward faces 221, 221', 221A, 221A'. The web 230, 230A in FIGS. 1 and 1A comprises web faces 231, 231' as shown in FIGS. 2A and 2B. The web 230, 230A engages inside the gap 125, 125A, and the two flanges 210, 220, 210A, 220A engages with the first 111, 111', 111A, 111A' and second 112, 112', 112A, 112A' contact surfaces.

FIGS. 2A-D shows schematically multiple views of an end connector 400 with a fastening device 500 and the profile part 200, where FIG. 2A shows schematically in perspective a view of the end connector 400; FIG. 2B shows an end view of the end connector 400, seen from the end intended to be inserted into a hole in the transom 300; FIG. 2C shows schematically an end view of alternative cross sectional shapes for the profile part 200 and the corresponding opening at the ends of the transom; and FIG. 2D shows schematically and in perspective a view of an end connector 400 and an end of the transom 300 in exploded view.

The profile part 200 is rigidly and permanently fixed to a fastening device 500, as shown in FIG. 2A. The I- or H-beam profile connected to the fastening device 500, together form the end connector 400 in FIG. 2A. The fastening device 500 can be other type of fastening means conventionally used in scaffolding and falsework technical field for connecting to a vertical pole 700 by use of a locking device 600. The surface of the fastening device 500 configured to face the vertical (not shown) has a concave surface to fit with a convex or curved surface of the vertical, face of the fastening device. As shown, the fastening device 500 extends beyond the height of the transom and is provided with a convex or curved outer surface to fit with a fixed lower cup (see FIG. 5) and a rotatable and adjustable upper cup.

When the profile part 200 is inserted and securely mounted inside the transom 300, 300A through openings 100, 100A, the contact surfaces 111, 111', 111A, 111A', 112, 112', 112A, 112A' and 113, 113', 113A, 113A' restrain the I- or H-beam profile movements and keep it in position inside the transom, also preventing rotation.

According to one embodiment of the invention, a transom 300, 300A is provided comprising an opening 100, 100A at an end 320, 320', 320A, 320A' of the transom 300, 300A. The transom 300, 300A is shown from a side view in FIGS. 1 and 1A. In the embodiments shown in FIGS. 1 and 1A, both ends 320, 320', 320A, 320A' of the transom 300, 300A have the same cross section configuration as the cross section configuration of the transom opening 100, 100A, however in other embodiments the opening 100, 100A can be arranged at one end only of the transom 300, 300A.

According to one embodiment of the invention, the profile part 200, 200A can be removably attached to the transom 300, 300A, for example using screws or bolts fitting in threaded holes for screws/bolts 330, other means for attachment obvious to the skilled person can also be used. The screws/bolts can extend through both web plates 123, 123' or 123A, 123A' and through the profile part 200, 200A so that the profile part 200, 200A and the transom 300, 300A are fastened together and avoid dislocation when in use in a structural system. Attaching the I- or H-beam profile to the transom 300, 300A avoids the I- or H-beam profile to move out from its position inside the opening 100, 100A. It also restricts the ability of the transom 300, 300A to dislodge from the I-beam profile when in use in scaffolding structure, for example due to excessive wind load.

FIG. 2A-C show different views of the end connector 400 having a profile part 200 for engaging with the opening 100, and the fastening device 500, shown as blade plates in all figures. The fastening device 500, is arranged for fitting with locking devices 600 conventionally used in scaffolding. The locking device 600, also referred to as coupling system, comprises a top cup 610 and a bottom 620. An example of such a locking device 600 is shown on FIG. 5.

FIG. 2D shows an exploded view of the transom 300 comprising the opening 100 and end connector 400 comprising the profile part 200.

FIG. 3 shows schematically and in perspective a view of an embodiment a tubular transom 300 with an end connector 400 attached to the transom 300, the transom 300 being with two end connectors 400, one at each end of the transom 300. In FIG. 3, both ends 320, 320' are temporarily fastened to the end connectors 400 by means of threaded screws/bolts extending through the holes for screws 330. In other embodiments, the end connector 400 can be mounted at one end only.

Figure 4:
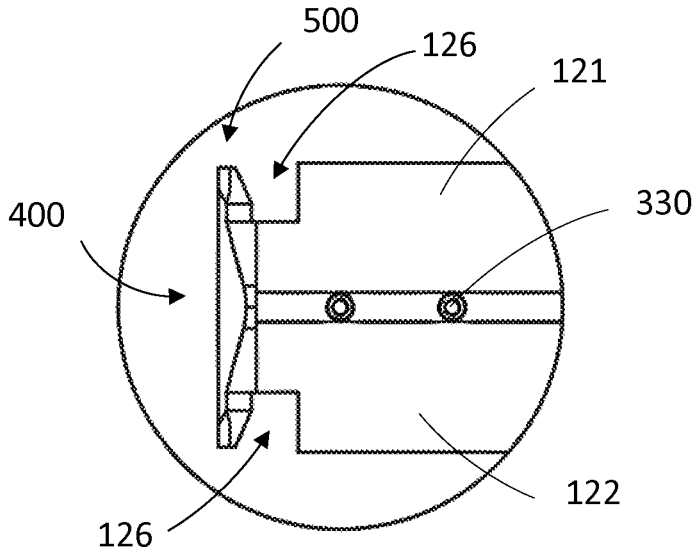
FIG. 4 shows schematically a detailed view of a tubular transom 300 end with the shown embodiment of an end connector 400 attached to the tubular transom end.

FIG. 4 shows a detail view of one end 320, 320A of the transom 300, 300A of FIG. 3.

In one embodiment of the invention, the transom opening 100, 100A further comprises a recess 126, 126A as shown in FIG. 1, 1A and FIGS. 3 and 4. The recess 126, 126A is arranged for receiving a rim of the top cup 610 and/or a bottom cup 620 of a locking device 600 conventionally used in scaffolding. This recess can also accommodate other types of end fixings compatible with other system types mentioned previously.

FIG. 5 shows three transoms 300 installed in locking device 600 on a vertical pole 700. The figure illustrates a transom 300 according to FIG. 1, but a transom 300A according to FIG. 1A may also be used. The transom 300, 300A comprises an opening 100, 100A engaged with the profile part 200, 200A of three end connectors 400 respectively. The top cup 610 and the bottom cup 620 are received in the recess 126, 126A parts of the three transoms 300, 300A. The top and bottom cups rigidly connect the fastening device 500 of the three end connectors 400 to one vertical pole 700, thereby connecting the transoms 300, 300A to the vertical pole 700 by means of the top and bottom cups.

FIG. 6 shows a plurality of transoms 300, 300A rigidly connected to a plurality of vertical poles 700 forming a scaffolding structure. The transoms 300, 300A comprise the opening 100, 100A at both ends 320, 320', 320A, 320A'. The openings 100, 100A of each transom 300, 300A is engaged and attached to the I-beam profile of an end connector 400 for coupling. The fastening device 500 of each end connector 400 is rigidly attached and secured on a vertical pole 700 by means of a top cup 610 and bottom cup 620 of a locking device 600. Thereby forming a scaffolding structure.

In one embodiment, the transom 300, 300A comprising the opening(s) 100, 100A is made of aluminium, which allows for a light weight transom. Other material made, however, can be used.

In an alternative embodiment, free surface at both sides of the I- or H-beam may have a curved, convex shape, corresponding to the inner, curved, concave shape of the tubes 121, 121A, 122, 122A.

In an alternative embodiment, transom may be made up of multiple tubes, i.e. more than two webs or web plates therebetween. In such embodiment profiled part 200, 200A will be modified accordingly.

According to a further alternative embodiment the web may be sliced in a pre-defined pattern and then pulled laterally apart in a transverse direction, establishing one or more lattice formed intermediate webs.

The following reference numbers and signs refer to the drawings:

| | |
|---|---|
| 100, 100A | Opening |
| 110, 110A | Body |
| 111, 111' | First contact surfaces |
| 111A, 111A' | |
| 112, 112' | Second opposite facing contact surfaces |
| 112A, 112A' | |
| 113, 113' | Web contact surfaces |
| 113A, 113A' | |
| 114, 114A | First tubular connecting inner surface |
| 115, 115A | Second tubular connecting inner surface |
| 121, 121A | First tube |
| 122, 122A | Second tube |
| 123, 123' | Web plates |
| 123A, 123A' | |
| 125, 125A | Opening |
| 126, 126A | Recess |
| 200, 200A | Profile part |

-continued

| | |
|---|---|
| 210, 210A | First flange |
| 211, 211' | First inward faces |
| 211A, 211A' | |
| 220, 220A | Second flange |
| 221, 221' | Second inward faces |
| 221A, 221A' | |
| 230, 230A | Web |
| 231, 231' | Web faces |
| 300, 300A | Tubular transom |
| 310 | Transom member |
| 320, 320' | Transom ends |
| 320A, 320A' | |
| 330 | Holes for screws |
| 400 | End connector |
| 500 | Fastening device |
| 600 | Locking device |
| 610 | Top cup |
| 620 | Bottom cup |
| 700 | Vertical pole |
| 800 | Node section |

INDUSTRIAL APPLICABILITY

The invention according to the application finds use in structural systems such as used for scaffolding, falsework, beams, bridges, staging, ski jumps and slopes and similar.

The invention claimed is:

1. A tubular transom (300, 300A) for temporary structures having vertical (700) and horizontal structural members connected together in nodes by means of locking devices (600) fixed at intervals on vertical members (700), the tubular transom (300, 300A) having ends configured to be connected to the verticals (700) at node sections (800), where each end (320, 320', 320A, 320A') of the transom (300, 300A) comprises a fastening device (500) with an integrated profile part (200, 200A), releasably attached to the tubular transom (300, 300A) through an opening (100, 100A) at the ends (320, 320', 320A, 320A') of the tubular transom (300, 300A); wherein the tubular transom (300, 300A) comprises a first (121, 121A) and at least second (122, 122A) elongate, parallel and hollow tube elements, interconnected at each end;

the opening (100, 100A) at the ends of the transom (300, 300A) having at least partly a shape complimentary to the shape of the profile part (200, 200A) for receiving an end of the profile part (200, 200A) into an interior end part of the first and second tube elements (121, 121A, 122, 122A); wherein the first and the at least second elongate, parallel and hollow tube elements (121, 121A, 122, 122A) are interconnected by means of intermediate integrated web plates (123, 123', 123A, 123A') rigidly fixed to said at least two tube elements (121, 121A, 122, 122A) and comprising web contact surfaces (113, 113', 113A, 113A'); and an opening (125, 125A) extends through said intermediate integrated web plates (123, 123', 123A, 123A') and is ended at one end in said first tube element (121, 121A) and at an opposite end is ended in the second tube element (122, 122A); wherein a contact surface (111, 111', 111A, 111A') of the opening (100, 100A) in the first tube element (121, 121A), is transversally arranged relative to said web plates (123, 123', 123A, 123A');

a contact surface (112, 112', 112A, 112A') of the opening (100, 100A) in the second tube element (122, 122A) is transversally arranged relative to said web plates (123, 123', 123A, 123A'), and wherein the contact surface (111, 111 ‘, 111A, 111A’) in the first tube element (121, 121A) is oppositely facing the contact surface (112, 112', 112A, 112A') in the second tube element (122, 122A) and both contact surfaces are arranged for at least partially engaging respectively with first faces (211, 21F, 211A, 211A') and second faces (221, 22F, 221A, 221A') of the profile part (200, 200A);

and wherein the fastening device (500) at each end of the transom (300, 300A) is adapted for engaging with the locking device (600) in the nodes of the temporary structure.

2. A tubular transom (300, 300A) according to claim 1, wherein the contact surfaces (111, 111', 111A, 111A', 112, 112', 112A, 112A') have a shape chosen from a group comprising flat and curved shapes.

3. A tubular transom (300, 300A) according to claim 1, further comprising attachment means (330) for temporarily and rigidly attaching the end connector (400) to the transom (300, 300A).

4. A tubular transom (300, 300A) according to claim 1, wherein the transom (300, 300A) comprises at least one recess section (126, 126A) arranged at one end of the transom (300, 300A) for receiving a locking device (600).

5. A tubular transom (300, 300A) according to claim 1, wherein the tubular transom (300, 300A) is made of a light-weight material.

6. A tubular transom (300, 300A) according to claim 3, wherein the transom (300, 300A) is made of extruded aluminum and that the opening (125, 125A) between the two intermediate web plates (123, 123', 123A, 123A') extends along the entire length of the transom (300, 300A).

7. A tubular transom (300, 300A) according to claim 1, wherein the first tube element (121, 121A) and/or the second tube element (122, 122A) comprises a circular or semi-circular outer shape.

* * * * *